United States Patent [19]

Kelly

[11] 4,199,180

[45] Apr. 22, 1980

[54] RESILIENTLY BIASED IMPLEMENT HOLDER

[76] Inventor: Joe L. Kelly, P.O. Box 38, Conyers, Ga. 30207

[21] Appl. No.: 904,622

[22] Filed: May 10, 1978

[51] Int. Cl.[2] ..... A47G 21/10

[52] U.S. Cl. ..... 294/33; 294/16; 294/99 R

[58] Field of Search ..... 294/33, 8.5, 11, 3, 294/99, 106, 16; 81/43; 128/321, 354; 24/253

[56] References Cited

U.S. PATENT DOCUMENTS

| | | | |
|---|---|---|---|
| 1,859,614 | 5/1932 | Boever | 294/33 |
| 2,711,339 | 6/1955 | McGogy | 294/11 |
| 2,860,537 | 11/1958 | Ferguson | 81/43 |
| 3,239,262 | 3/1966 | Rines et al. | 294/99 R |

FOREIGN PATENT DOCUMENTS

| | | | |
|---|---|---|---|
| 180099 | 5/1922 | United Kingdom | 294/16 |

*Primary Examiner*—James B. Marbert

*Attorney, Agent, or Firm*—Newton, Hopkins & Ormsby

[57] ABSTRACT

A split resilient ring has a pair of converging implement socketing sleeves anchored thereto and adapted to receive various implements whose work-engaging terminals may extend substantially outwardly of one or both corresponding ends of the socketing sleeves. The work-engaging implement terminals can be biased apart or together by the holder for a variety of useful operations. In lieu of the split resilient ring, a wedge fulcrum member may engage converging or diverging implements biased by elastic elements.

10 Claims, 25 Drawing Figures

RESILIENTLY BIASED IMPLEMENT HOLDER

BACKGROUND OF THE INVENTION

The objective of the invention is to provide inexpensively a highly versatile and convenient biased holder for a variety of implements ranging from kitchen tongs, tweezers and clamps to chopsticks or the like. In essence, the invention seeks to provide a basic spring holder for detachable implements which engage in socket elements or sleeves permanently attached to the spring holder. In most instances, the basic spring holder consists of a split ring having a pair of convergent preferably conically tapered implement socketing sleeves anchored within openings of the split ring which lie on opposite sides of the ring division line on axes which extend chordwise of the ring. A salient feature of the device is that the active ends of implements socketed in the convergent sleeves may be disposed selectively beyond either corresponding ends of the sleeves.

A wide variety of resilient gripping and tweezer or tong-like implements are known in the prior art, but none of the prior art devices possesses the universality of the biased implement holder herein or the wide range of utility inherently embodied in it.

To comply with the duty of disclosing known prior art under 37 C.F.R. 1.56, the following U.S. patents are made of record herein:

U.S. Pat. Nos. 211,855, 788,672, 884,680, 1,260,302, 1,315,808, 1,707,947, 1,745,411, 1,765,974, 2,629,276, 2,887,110, 3,293,958, 3,323,825, 3,398,746, 3,559,515, 3,637,248, 4,012,068, 4,023,450.

DETAILED DESCRIPTION

Figure 1:
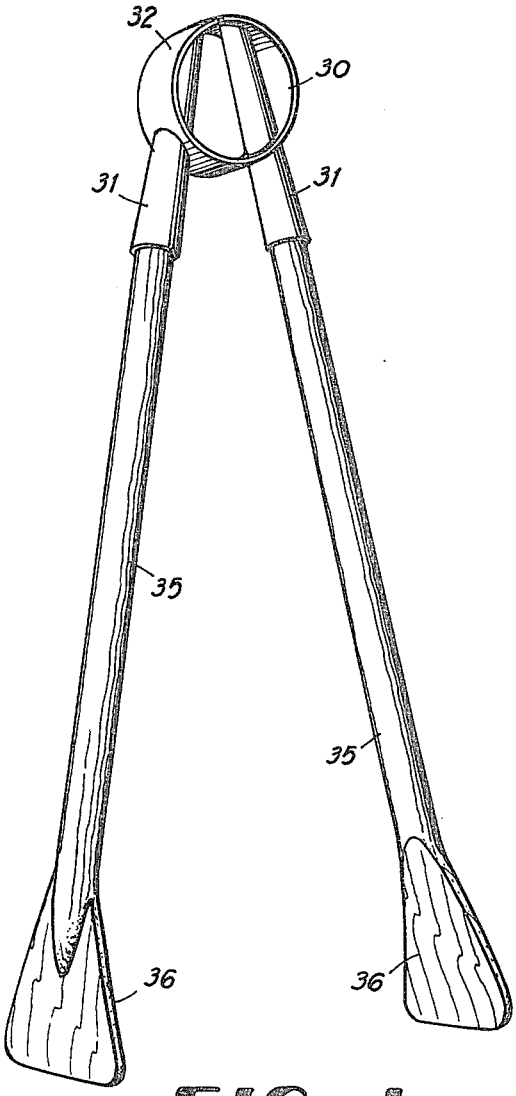
FIG. 1 is a perspective view of a biased implement holder according to the invention and showing the use of the same with a pair of tong implements.
Figure 2:
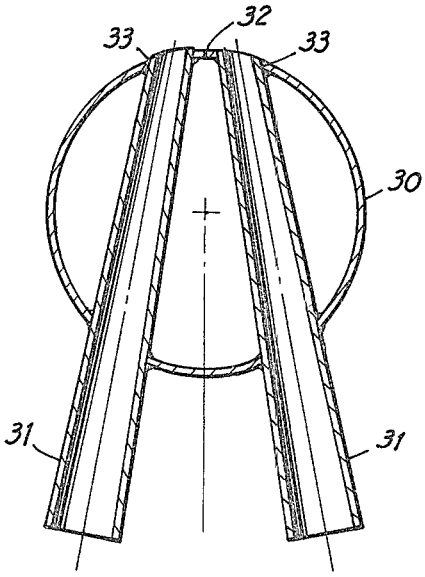
FIG. 2 is an enlarged central vertical cross section through the implement holder in FIG. 1.
Figure 3:
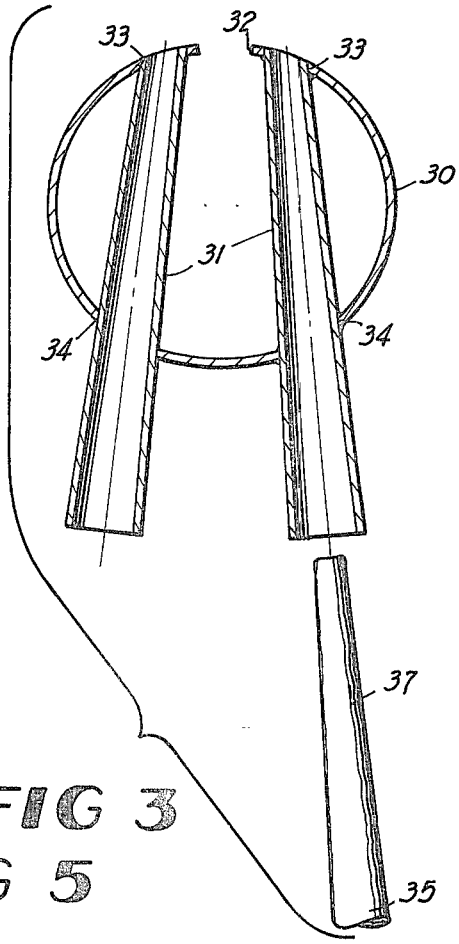
FIG. 3 is an exploded view, partly in cross section, with the biased implement holder expanded.

Referring to the drawings in detail and initially to FIGS. 1 to 3, there is shown a biased holder for implements comprising a split annulus 30 or body portion formed of resilient material, such as spring metal. In some cases, the annulus 30 may have a modified shape such as elliptical rather than being circular, as illustrated. The biased implement holder further comprises a pair of preferably conically tapered sleeves 31 arranged symmetrically on opposite sides of the division 32 of the split annulus 30. The sleeves 31 converge toward their smaller ends which ends are fixedly and permanently anchored in openings 33 formed through the annulus 30. As illustrated, the smaller ends of the sleeves 31 terminate substantially flush with the periphery of the annulus 30. Intermediate their ends, the two sleeves 31 are further secured within another pair of openings 34 of the split annulus and the larger end portions of the tapering sleeves project substantially beyond the portion of the annulus away from its division 32. The two sleeves 31 have axes which extend chordwise through the spring annulus, as shown.

In the biased holder, the tapered sleeves 31 form friction socketing elements for implement shafts 35 having working terminals 36. As shown in FIG. 1, the shafts 35 and terminals 36 constitute kitchen tongs or the like which diverge from the biased holder and are resiliently biased apart or open with the division 32 normally closed. Manual squeezing pressure on the shafts 35 will close the tongs causing separation of the split annulus 30, as shown in FIG. 3.

The end portions 37 of the shafts 35 which are received in the socketing sleeves 31 are tapered to mate frictionally and snugly in the sleeves, as illustrated in FIG. 3.

Figure 4:
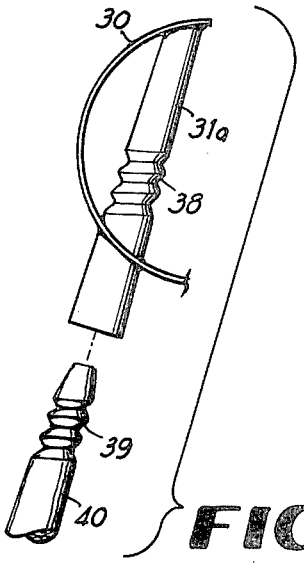
FIG. 4 is a fragmentary exploded elevational view showing a variation in the connection between the holder and an implement.

In lieu of simple frictional engagement, FIG. 4, each sleeve 31*a* may be threaded as at 38 within the annulus 30 for engagement with threads 39 on the socketed portion 40 of the implement or tong shafts 35.

Figure 5:
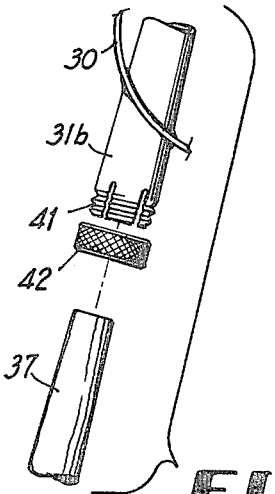
FIG. 5 is a similar view showing another variation in the connection between holder and implement.

A further variation in the connection is shown in FIG. 5 wherein each tapered sleeve 31*b* is split and externally threaded at its larger end portion 41 to receive the tapered terminal 37 of the implement shaft which becomes locked in the sleeve 31*b* following application of a clamping nut 42. Other types of connections may be employed.

Figure 6:
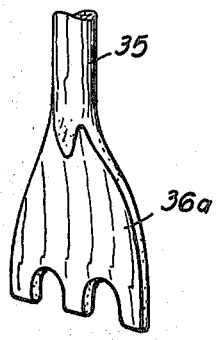
FIGS. 6 to 12 are further fragmentary perspective views illustrating variations in the work-engaging terminals of various implements which may be used with the biased holder in FIGS. 1 to 3.
Figure 7:
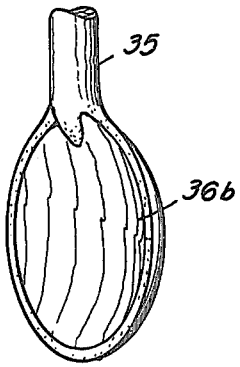
Figure 8:
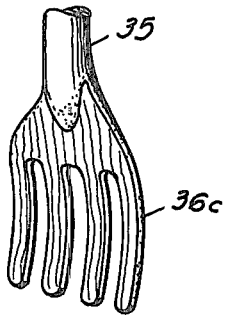
Figure 9:
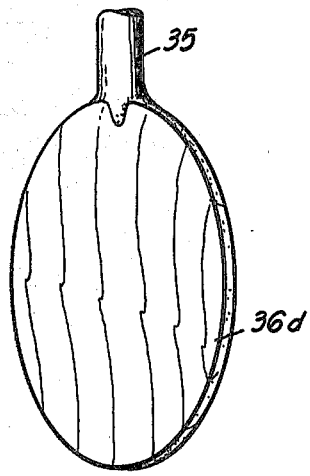
Figure 10:
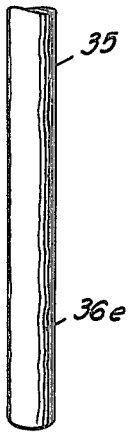
Figure 11:
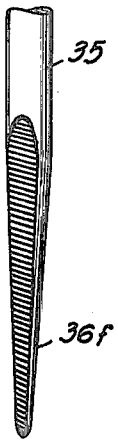
Figure 12:
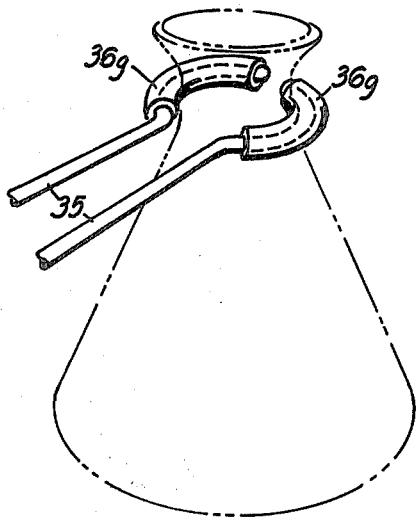

FIGS. 6 through 12 simply show variations in the working terminals 36 of the tongs or implement held in the biased holder. FIG. 6 shows a toothed terminal 36*a*. FIGS. 7 and 8, respectively, show spoon and fork terminals 36*b* and 36*c*; FIGS. 9, 10 and 11 show disc, rod and serrated tweezer terminals 36*d*, 36*e* and 36*f* while FIG. 12 shows padded arcuate gripping jaw terminals 36*g*.

Figure 13:
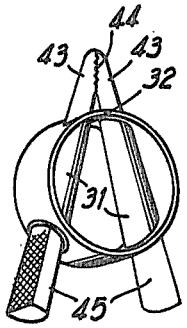
FIG. 13 is a perspective view of the implement holder in association with implements which are biased into gripping engagement reversely of the arrangement in FIG. 1 where the implements are biased apart.

FIGS. 13 to 16 illustrate the diverse utility of the biased implement holder as described in FIGS. 1 to 3. More particularly, FIGS. 13 to 16 show a reverse or reciprocal mode of use compared to FIG. 1 wherein the implement shafts 35 are biased apart by the holder and diverge until drawn together manually. In FIG. 13, comparatively short tapered tweezer-like implements 43 are biased together by the resilient holder in gripping relationship with the work engaging faces 44 projecting outwardly beyond the division 32 of the resilient annulus 30. This is the opposite of the arrangement in FIG. 1 where the shafts 35 are biased apart and project beyond the portion of the annulus 30 which is remote from the division 32. In FIG. 13, tweezer handle extensions 45 project in diverging relationship beyond the portion of the annulus 30 remote from the division 32. The tweezer elements 43 like the shafts 35 can be socketed frictionally in the sleeves 31 of the holder.

Figure 14:
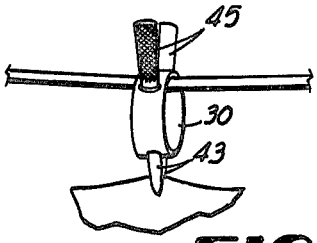
FIG. 14 is a perspective view depicting one use of the device in FIG. 13.
Figure 15:
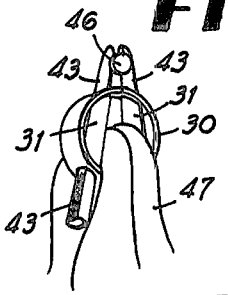
FIG. 15 is a similar view depicting another use of the device in FIG. 13.

FIG. 14 illustrates one usage of the device in FIG. 13 as a clothespin. FIG. 15 shows another usage of the same device as a towel holder with the biased jaws 43 gripping a nail 46 while a towel 47 is draped through the annulus 30.

Figure 16:
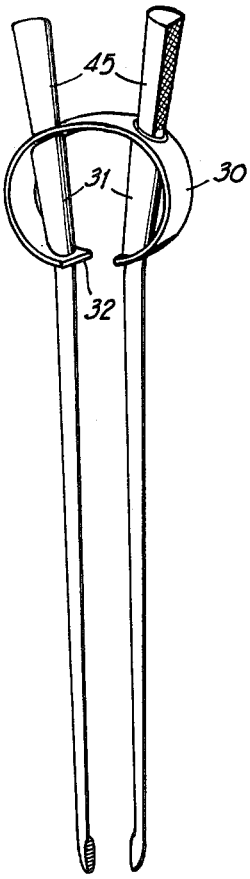
FIG. 16 is a perspective view showing a modification of the device in FIG. 13.

FIG. 16 shows yet another use of the device according to FIG. 13 for what may be termed a needle-nosed tweezer.

Figure 17:
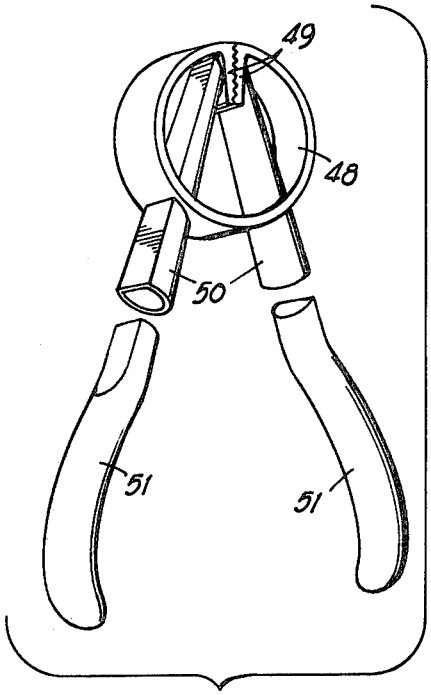
FIGS. 17 and 18 are perspective views showing a further modification of the biased implement holder in the nature of a clamp.
Figure 18:
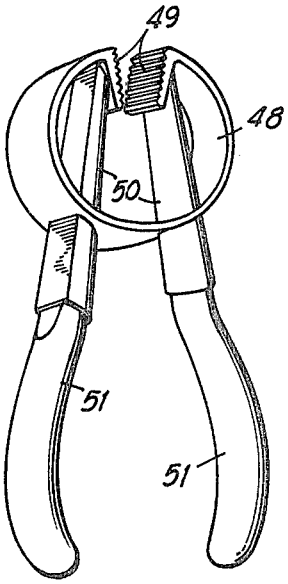

FIGS. 17 and 18 show a biased clamp embodiment of the generic invention, wherein a split resilient annulus 48 has serrated radially inwardly clamping jaws 49 integral therewith which are biased closed. Convergent socketing sleeves 50 similar to the sleeves 31 are provided on the annulus 48 to releasably receive clamp operating handles 51 which are biased apart, FIG. 17, and are squeezed together, FIG. 18, to open the spring clamp. Again, the diverse utility of the basic biased implement holder is shown.

Figure 19:
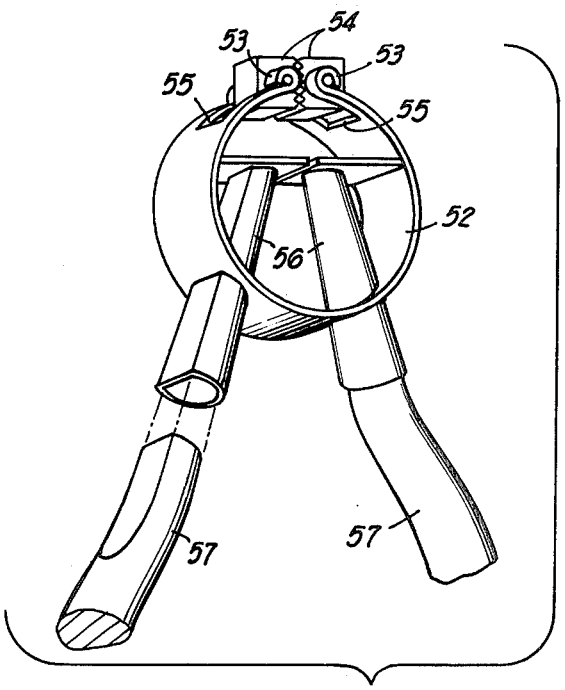
FIG. 19 is a perspective view showing a modification of the device in FIGS. 17 and 18.
Figure 20:
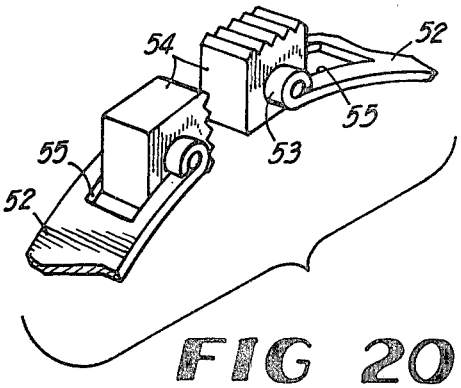
FIGS. 20 and 21 are enlarged fragmentary views in perspective and in cross section showing details of floating gripping heads included on the device in FIG. 19.
Figure 21:
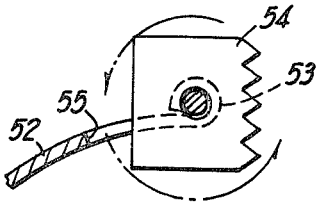

FIGS. 19 through 21 show a variant of the clamp in FIGS. 17 and 18 wherein the split spring annulus 52 has knuckles 53 formed at its ends on which serrated block-like jaws 54 are pivotally or floatingly mounted within notches 55 or clearance spaces. Converging fixed socketing sleeves 56 receive handles 57 similar or identical to the handles 51. The clamp according to FIGS. 19 through 21 is self-adjusting through the floating jaws 54 to grip uneven surfaces.

Figure 22:
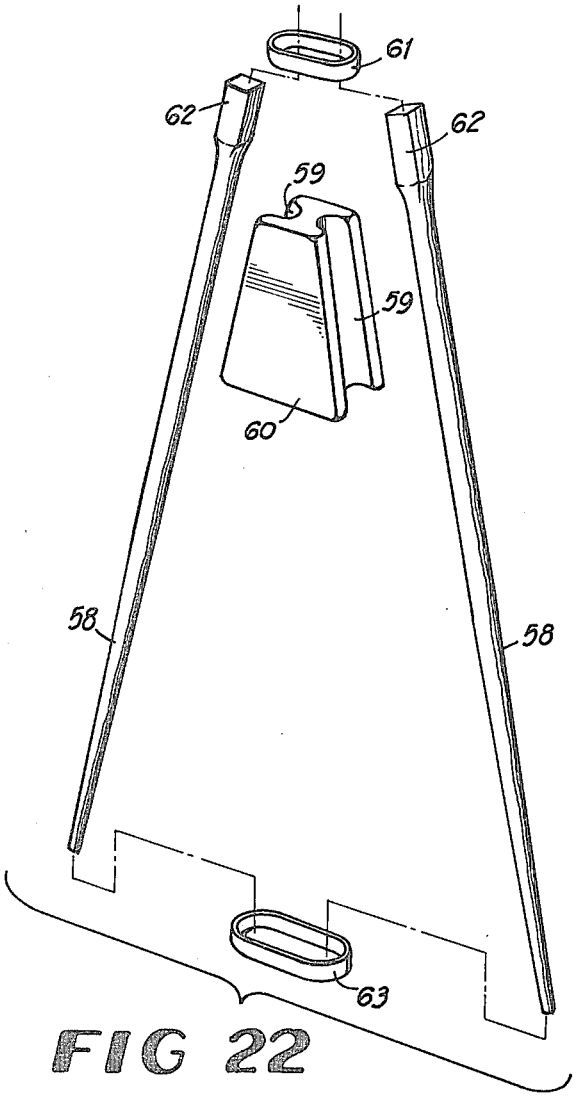
FIG. 22 is an exploded perspective view of chopsticks embodied in the invention.
Figure 23:
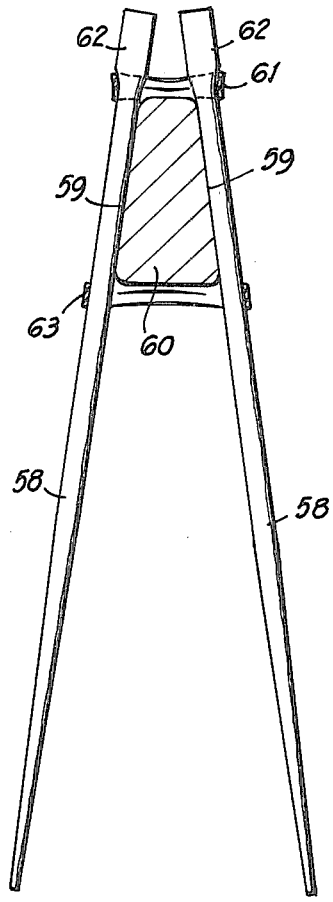
FIG. 23 is an assembled elevational view, partly in cross section, of the chopsticks in FIG. 22.

FIGS. 22 and 23 show a chopsticks embodiment of the invention wherein chopsticks 58 are seated in opposite side convergent grooves 59 of a wedge fulcrum element 60. A first elastic band 61 immediately above the wedge fulcrum 60 surrounds the chopsticks at the bottom of enlarged terminals 62 provided thereon. A second elastic band 63 similarly surrounds the chopsticks 58 immediately below the wedge fulcrum 60. The two elastic bands retain the chopsticks seated in the groove 59 and the chopsticks are biased apart in a manner similar to the biasing of the shafts 35 in FIG. 1. When the chopsticks are manually drawn together during usage, the resiliently biased holding means will yield to permit the necessary tong-like action similar to the action of the device in FIG. 1.

Figure 24:
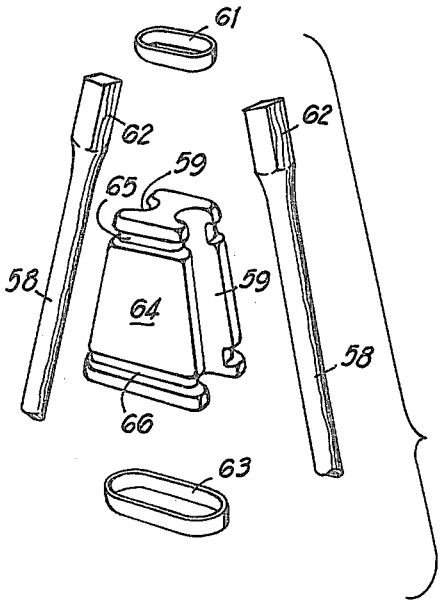
FIG. 24 is an exploded perspective view showing a variant of the chopsticks construction.
Figure 25:
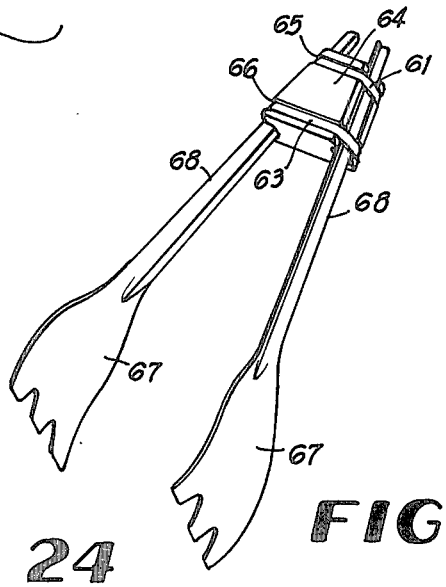
FIG. 25 is a perspective view showing a further application of the construction in FIG. 24.

FIGS. 24 and 25 show a variant of the invention in FIGS. 22 and 23 wherein a wedge fulcrum element 64 having the side grooves 59 to receive the chopsticks 58 also has upper and lower perimeter grooves 65 and 66 to form seating and locating means for the two elastic bands 61 and 63 in the assembled biased chopsticks. FIG. 25 also illustrates how chopsticks can be transformed into tongs similar to the biased tongs of FIG. 1 by the addition of appropriate engaging elements 67 on the shafts 68. Once again, the universality and the diverse utility of the resiliently biased implement holder is demonstrated.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A biased holder for diverse rod-like implements comprising a body portion having spaced seating means for a pair of coacting implements, with a part of said body portion lying between said seating means and providing a fulcrum about which implements seated in said seating means may be moved, said body portion including resilient means associated therewith and biasing said implements to one operative position and yielding to allow movement of the implements under manual force to a second operative position, said body portion comprising a divided arcuate resilient member, and said seating means comprising a pair of sleeves on said arcuate resilient member adapted to receive and hold terminals of a coacting pair of rod-like implements, said divided arcuate resilient member being a divided annulus, and said sleeves being convergent and tapering toward corresponding ends and being fixedly secured to said annulus on opposite sides of the division in the annulus and being on axes which extend chordwise of the annulus.

2. A biased holder for diverse rod-like implements as defined in claim 1, and the corresponding smaller ends of said sleeves being anchored within openings formed in the annulus near said division and being substantially flush with the periphery of the annulus, and the corresponding larger ends of the sleeves projecting for substantial distances equidistantly beyond that portion of the annulus opposite to the division.

3. A biased holder for diverse rod-like implements as defined in claim 1, and said sleeves being threaded at least throughout portions of their lengths.

4. A biased holder for diverse rod-like implements as defined in claim 1, and corresponding ends of said sleeves being slotted and screw-threaded, and clamping nuts engageable on said sleeves to draw their slotted screw-threaded ends into gripping engagement with end terminals of the rod-like implements.

5. A biased holder for diverse rod-like implements as defined in claim 1, and a pair of rod-like implements engaged in said sleeves and projecting from the convergent ends of the sleeves and being convergent and being biased into opposed clamping relationship by spring force in the divided annulus tending to close the annulus.

6. A biased holder for diverse rod-like implements as defined in claim 1, and a pair of opposing radially extending clamping jaws carried directly by the divided ends of the annulus and between said sleeves.

7. A biased holder for diverse rod-like implements as defined in claim 1, and a pair of coacting pivotal floating jaws on the divided ends of said annulus.

8. A biased holder for diverse rod-like implements comprising a body portion having spaced seating means for a pair of coacting implements, with a part of said body portion lying between said seating means and providing a fulcrum about which implements seated in said seating means may be moved, said body portion including resilient means associated therewith and biasing said implements to one operative position and yielding to allow movement of the implements under manual force to a second operative position, said body portion comprising a wedge-like fulcrum element having seating grooves for rod-like implements in opposite sides thereof with the seating grooves being convergent, and said biasing means consisting of a pair of elastic bands near the ends of the fulcrum element embracing a pair of rod-like implements in said seating grooves and biasing the implements in seated divergent relationship with the implements extending for substantial distances beyond one end of the fulcrum element.

9. A biased holder for diverse rod-like implements as defined in claim 8, and said wedge-like fulcrum element additionally having a pair of perimeter grooves formed therein near its opposite ends and intersecting said seating grooves, the perimeter grooves serving to locate and seat said pair of elastic bands.

10. A biased holder for diverse rod-like implements comprising a divided annulus composed of resilient material and tending to assume a position in which the division is closed, a pair of tubular members each of which extends as a chord across a portion of said annulus, said members opening at one end through said annulus at points adjacent to and on opposite sides of the division of said annulus, said tubular members diverging from such openings and opening through the annulus at points generally opposite to said first openings, said tubular members being adapted to receive rod-like implements.

* * * * *